US011555337B2

(12) United States Patent
Ishiguro et al.

(10) Patent No.: US 11,555,337 B2
(45) Date of Patent: Jan. 17, 2023

(54) VEHICLE DOOR LATCH APPARATUS

(71) Applicant: MITSUI KINZOKU ACT CORPORATION, Yokohama (JP)

(72) Inventors: Katsuyuki Ishiguro, Yokohama (JP); Hirotaka Nishijima, Yokohama (JP); Shunsuke Tamura, Yokohama (JP); Shintaro Okawa, Yokohama (JP)

(73) Assignee: MITSUI KINZOKU ACT CORPORATION, Yokohama (JP)

( * ) Notice: Subject to any disclaimer, the term of this patent is extended or adjusted under 35 U.S.C. 154(b) by 148 days.

(21) Appl. No.: 17/047,066

(22) PCT Filed: Aug. 7, 2018

(86) PCT No.: PCT/JP2018/029543

§ 371 (c)(1),
(2) Date: Oct. 12, 2020

(87) PCT Pub. No.: WO2019/202751

PCT Pub. Date: Oct. 24, 2019

(65) Prior Publication Data

US 2021/0156175 A1 May 27, 2021

(30) Foreign Application Priority Data

Apr. 18, 2018 (JP) ..... JP2018-080280

(51) Int. Cl.
*E05B 81/16* (2014.01)
*E05B 81/44* (2014.01)
*E05B 81/14* (2014.01)

(52) U.S. Cl.
CPC ..... *E05B 81/16* (2013.01); *E05B 81/14* (2013.01); *E05B 81/44* (2013.01); *E05Y 2900/531* (2013.01)

(58) Field of Classification Search
CPC ..... E05B 79/22; E05B 81/00; E05B 81/02; E05B 81/04; E05B 81/06; E05B 81/12;
(Continued)

(56) References Cited

U.S. PATENT DOCUMENTS 4,518,181 A * 5/1985 Yamada ..... E05B 81/34 292/201
9,551,172 B2 1/2017 Barmscheidt et al.
(Continued)

FOREIGN PATENT DOCUMENTS

EP 1045093 A2 * 10/2000 ..... E05B 81/14
EP 1503012 A1 * 2/2005 ..... E05B 81/14
(Continued)

OTHER PUBLICATIONS

International Searching Authority, "International Search Report," issued in connection with International Patent Application No. PCT/JP2018/029543, dated Sep. 11, 2018.
(Continued)

*Primary Examiner* — Christine M Mills
*Assistant Examiner* — Christopher F Callahan
(74) *Attorney, Agent, or Firm* — Foley & Lardner LLP

(57) ABSTRACT

A vehicle door latch apparatus has latch mechanism, powered release means, manual release means and lock mechanism that is switched between a locked state and an unlocked state. Powered release means has cam wheel that is rotated in normal and in reverse rotational directions from a reference position by motor power. When cam wheel is rotated in the normal rotational direction from the reference position, latch mechanism is released while lock mechanism is held in the locked state When cam wheel is rotated in the reverse rotational direction from the reference position, cam wheel switches lock mechanism to the unlocked state. Cam wheel returns lock mechanism to the locked state when cam wheel is rotated in the normal rotational direction back to the reference position in the unlocked state.

8 Claims, 10 Drawing Sheets

(58) Field of Classification Search
CPC ..... E05B 81/14; E05B 81/16; E05B 81/24; E05B 81/26; E05B 81/30; E05B 81/32; E05B 81/42; E05B 81/80; E05B 81/82; E05B 81/90; E05B 85/20; E05B 85/24; E05B 85/243; E05B 85/26; E05B 81/44; Y10T 292/1047; Y10T 292/1082; Y10S 292/23; Y10S 292/65
See application file for complete search history.

(56) References Cited

U.S. PATENT DOCUMENTS

| | | | | |
|---|---|---|---|---|
| 2006/0103145 | A1 | 5/2006 | Ottolini et al. | |
| 2009/0267359 | A1* | 10/2009 | Takayanagi ..... | E05B 81/14 292/201 |
| 2017/0159331 | A1 | 6/2017 | Handke | |
| 2017/0314298 | A1* | 11/2017 | Tomaszewski ..... | E05B 77/30 |
| 2018/0155965 | A1* | 6/2018 | Estrada ..... | E05B 81/20 |

FOREIGN PATENT DOCUMENTS

| | | | |
|---|---|---|---|
| GB | 2 433 768 | A | 7/2007 |
| JP | H09-105262 | A | 4/1997 |
| JP | 2014-511447 | A | 5/2014 |
| WO | WO-2015/113545 | A1 | 8/2015 |

OTHER PUBLICATIONS

International Searching Authority, "Written Opinion," issued in connection with International Patent Application No. PCT/JP2018/029543, dated Sep. 11, 2018.

* cited by examiner

VEHICLE DOOR LATCH APPARATUS

TECHNICAL FIELD

This present application claims priority under 37 U.S.C. § 371 to International Patent Application No. PCT/JP2018/029543, filed on Aug. 7, 2018, which claims priority to and the benefit of Japanese Patent Application No. 2018-080280, filed on Apr. 18, 2018. The contents of these applications are hereby incorporated by reference in their entireties.

The present invention relates to a vehicle door latch apparatus, particularly to a vehicle door latch apparatus having powered release means, manual release means and a lock mechanism.

BACKGROUND OF THE INVENTION

JP6213927 (U.S. Pat. No. 9,551,172) discloses a vehicle door latch apparatus having powered release means that releases a latch mechanism by motor power, manual release means that releases the latch mechanism by manual operation force and a lock mechanism that is switched between a locked state, where the manual release means is deactivated, and an unlocked state, where the manual release means can be activated.

In the vehicle door latch apparatus described in the above-mentioned patent document, the latch mechanism is released only by the powered release means, and manual release means is provided as complementary means when the powered release means is deactivated. For this reason, the lock mechanism, which is only used to switch the operation state of the manual release means, is usually used in the locked state, and is switched to the unlocked state only in case of an emergency. The switching between the locked state and the unlocked states of the lock mechanism is carried out by a cam body that is rotated in the normal and reverse directions by motor power. The cam body is held at a neutral position by the elastic force of a return spring. When the cam body is rotated in the normal direction from the neutral position, the lock mechanism is switched to the locked state, and when the cam body is rotated reversely from the neutral position, the lock mechanism is switched to the unlocked state. The cam body releases the latch mechanism when the cam body is rotated in the normal direction from the neutral position. It is thus possible to switch the lock mechanism and to release the latch mechanism by means of a single motor, i.e., the powered release means.

SUMMARY OF THE INVENTION

In the vehicle door latch apparatus described in the above-mentioned patent document, the lock mechanism cannot be switched to the locked state without releasing the latch mechanism. Therefore, the vehicle door latch apparatus described in the above-described patent document is not convenient, and it is impossible to switch the lock mechanism based on a user's judgment or by means of a vehicle speed sensor.

Thus, according to an aspect, a vehicle door latch apparatus comprises:

a latch mechanism that keeps a vehicle door closed;

powered release means that can release the latch mechanism with motor power;

manual release means that can release the latch mechanism with manual operation force; and a lock mechanism that is switched between a locked state where the manual release means is deactivated and an unlocked state where the manual release means can be activated, wherein the powered release means has a cam wheel that is rotated in normal and in reverse rotational directions from a reference position by motor power, when the cam wheel is at the reference position, the lock mechanism is held in the locked state, when the cam wheel is rotated in the normal rotational direction from the reference position, the cam wheel can release the latch mechanism while the lock mechanism is held in the locked state when the cam wheel is rotated in the reverse rotational direction from the reference position, the cam wheel switches the lock mechanism to the unlocked state, and the cam wheel returns the lock mechanism to the locked state when the cam wheel is rotated in the normal rotational direction back to the reference position after the cam wheel is rotated in the reverse rotational direction from the reference position.

According to the inventions of claims 1 to 4 of the present invention, since the lock mechanism can be switched between the locked state and the unlocked state by the motor of the powered release means without releasing the latch mechanism, a remarkable improvement in convenience can be expected. Similar effects can be expected in the inventions of claims 5 to 10 of the present invention.

The above and other objects, features and advantages of the present invention will become apparent from the following description with reference to the accompanying drawings which illustrate examples of the present invention.

EXPLANATION OF REFERENCE NUMERALS

10 . . . vehicle door latch apparatus, 11 . . . latch mechanism, 12 . . . striker, 13 . . . latch, 13*a* . . . striker engaging groove, 13*b* . . . full latch engaging portion, 13*c* . . . half latch engaging portion, 13*d* . . . connecting slope, 14 . . . ratchet, 14*a* . . . claw portion, 14*b* . . . ratchet pin, 14*c* . . . coupling shaft, 15 . . . latch shaft, 16 . . . ratchet shaft, 17 . . . manual release means, 18 . . . opening lever, 19 . . . opening shaft, 20 . . . lock mechanism, 21 . . . opening link, 21*a* . . . abutting surface, 21*b* . . . guide slot, 22 . . . pin, 23 . . . follower lever, 23*a* . . . slide pin, 23*b* . . . follower pin, 24 . . . support shaft, 25 . . . powered release means (lock switching mechanism), 26 . . . cam wheel, 27 . . . motor, 28 . . . cam shaft, 29 . . . cam groove, 29*a* . . . annular groove, 29*b* . . . branch groove, 29*c* . . . inner end, 29*d* . . . outer end, 29*e* . . . guide wall, 30 . . . path, 31 . . . base lever, 31*a* . . . metal plate, 31*b* . . . resin cover, 31*c* . . . shaft hole, 31*d* . . . bifurcating portion, 31*e* . . . outer wall, 32 . . . pawl lever, 32*a* . . . metal plate, 32*b* . . . resin cover, 33 . . . gap, 34 . . . ratchet spring, 34*a* . . . coil portion, 34*b* . . . spring leg portion, 34*c* . . . spring leg portion, 35 . . . ratchet restraint, 35*a* . . . blocking surface, 35*b* . . . releasing surface, 35*c* . . . return cam surface, 36 . . . support shaft, 37 . . . connecting pin

DETAILED DESCRIPTION OF THE INVENTION

Figure 1:
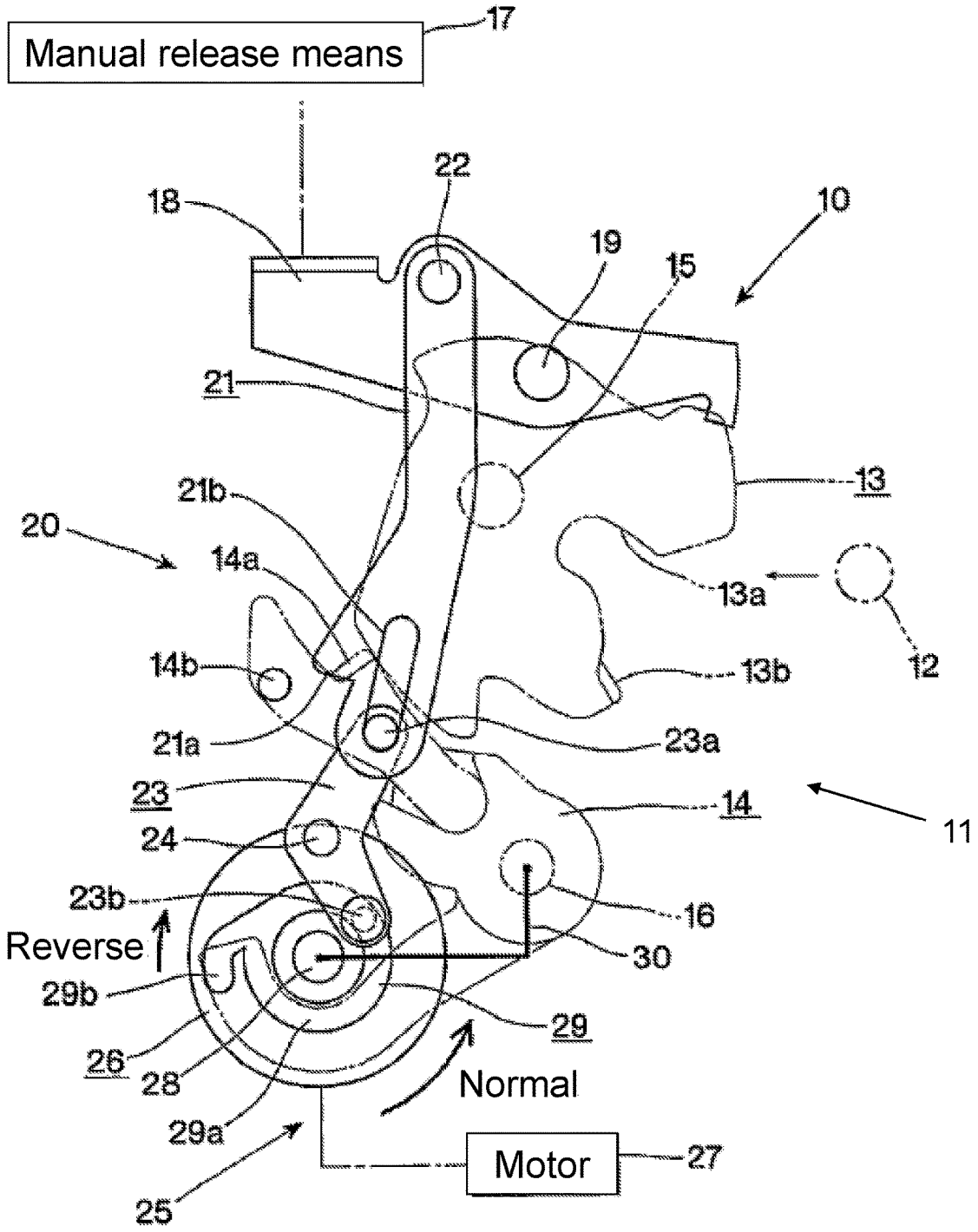
FIG. 1 is a front view showing a vehicle door latch apparatus of the present invention when the door is open.

An embodiment of the present invention will be explained with reference to the drawings. FIG. 1 shows vehicle door latch apparatus 10 in the door opened state. Vehicle door latch apparatus 10 has latch mechanism 11, which is shown by the virtual lines. Latch mechanism 11 includes latch 13 that engages striker 12 of the vehicle and ratchet 14 that engages latch 13. Latch 13 is rotatably supported by latch shaft 15, and ratchet 14 is rotatably supported by ratchet shaft 16.

Figure 2:
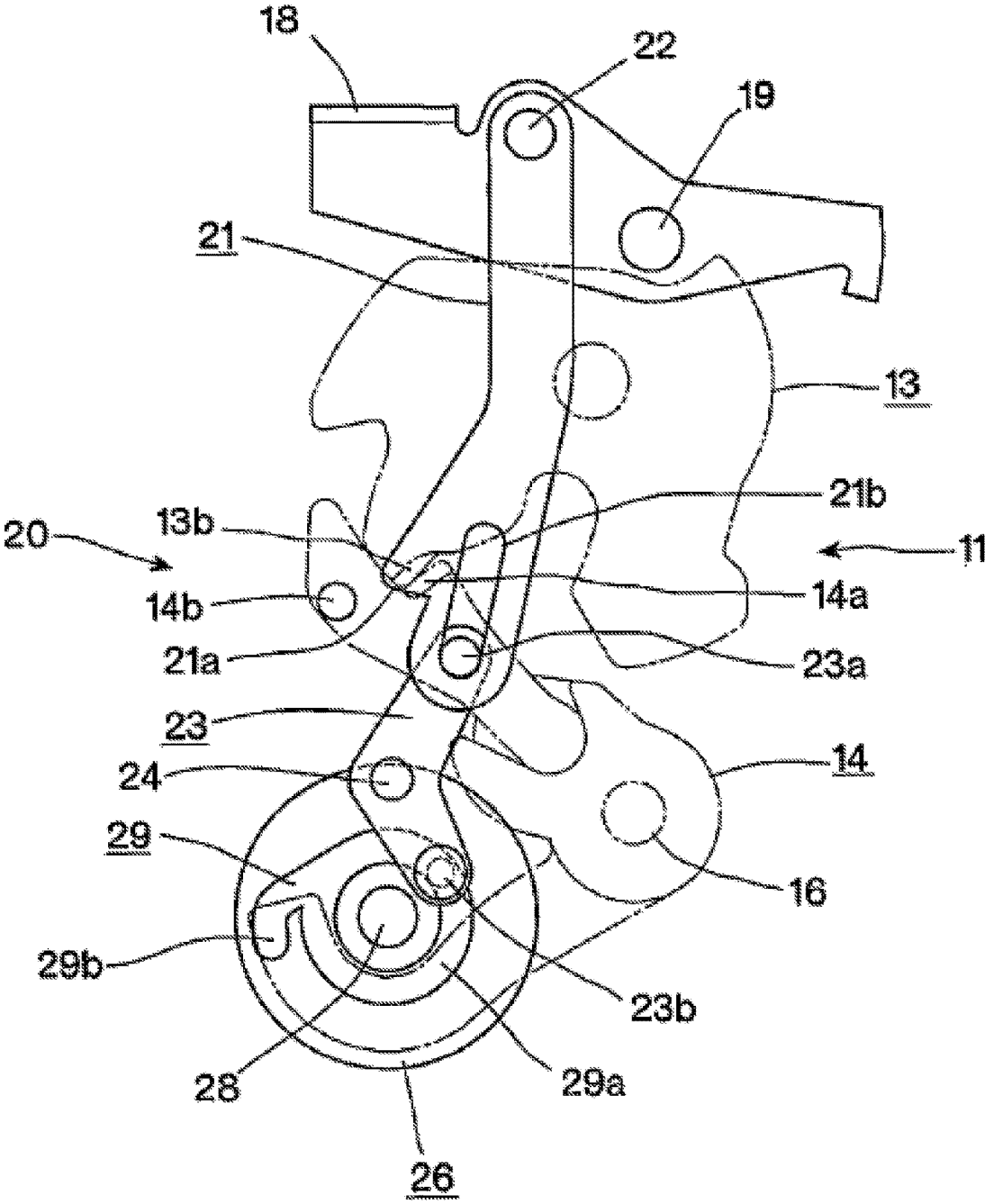
FIG. 2 is a front view showing the vehicle door latch apparatus in the locked state when the door is closed.

When the vehicle door is moved in the door closing direction, striker 12 abuts against U-shaped striker engaging groove 13*a* of latch 13 in order to rotate latch 13 in the full latching direction (in the clockwise direction). When latch 13 is at the fully-latched position, pawl portion 14*a* of ratchet 14 engages full latch engaging portion 13*b*, and the door closing operation is completed, as shown in FIG. 2.

Vehicle door latch apparatus 10 has manual release means 17 and opening lever 18 that is rotated by manual release means 17. Opening lever 18 is rotatably supported by opening shaft 19. Manual release means 17 corresponds to an outer opening handle or an inner opening handle of the door. Manual release means 17 can disengage latch 13 from ratchet 14 by manual operation force.

Vehicle door latch apparatus 10 has lock mechanism 20. Lock mechanism 20 is switched between the locked state, where latch mechanism 11 is prevented from being released by manual release means 17 (opening lever 18) (where manual release means 17 is disabled) and the unlocked state, where latch mechanism 11 is allowed to be released by manual release means 17 (opening lever 18) (where manual release means 17 can be activated). Lock mechanism 20 is connected both to manual release means 17 and to ratchet 14.

Lock mechanism 20 has elongate opening link 21. The upper portion of opening link 21 is coupled to opening lever 18 by means of pin 22. Laterally protruding abutting surface 21*a* and longitudinally extending guide slot 21*b* are formed at the lower portion of opening link 21.

Lock mechanism 20 has follower lever 23. Follower lever 23 is rotatably supported by support shaft 24. Slide pin 23*a*, which is provided at one end of follower lever 23, slidably engages guide slot 21*b*. In other words, follower lever 23 is connected to opening link 21 through guide slot 21*b*. Follower pin 23*b* is provided at the other end of follower lever 23.

FIG. 2 shows lock mechanism 20 in the locked state. In the locked state, abutting surface 21*a* of opening link 21 is laterally spaced from ratchet pin 14*b* of ratchet 14. Therefore, even if opening lever 18 is rotated by manual release means 17 in order to make opening link 21 move down, abutting surface 21*a* does not abut against ratchet pin 14*b*, and it is therefore impossible to disengage ratchet 14 from latch 13. In other words, in the locked state, manual release means 17 cannot release latch mechanism 11. The position of opening link 21 at this time is referred to as a first position.

Figure 3:
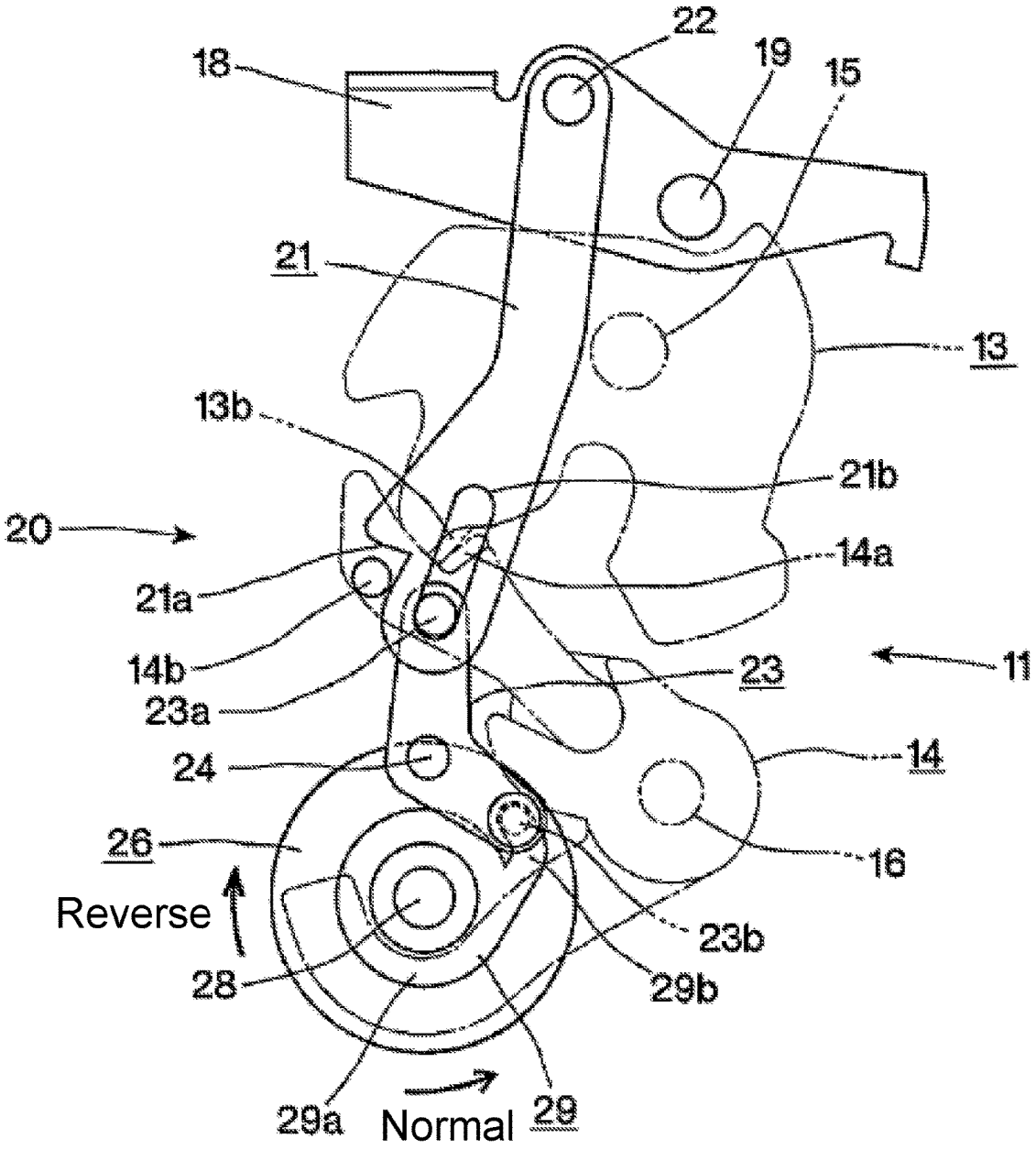
FIG. 3 is a front view showing the vehicle door latch apparatus in the unlocked state when the door is closed.

In the locked state shown in FIG. 2, when follower lever 23 is rotated counterclockwise about support shaft 24, opening link 21 is moved leftward about upper pin 22 due to the engagement between slide pin 23*a* and guide slot 21*b*, as shown in FIG. 3. Then, abutting surface 21*a* of opening link 21 faces ratchet pin 14*b* of ratchet 14 in the vertical direction, and lock mechanism 20 is switched to the unlocked state. The position of opening link 21 at this time is referred to as a second position.

Figure 4:
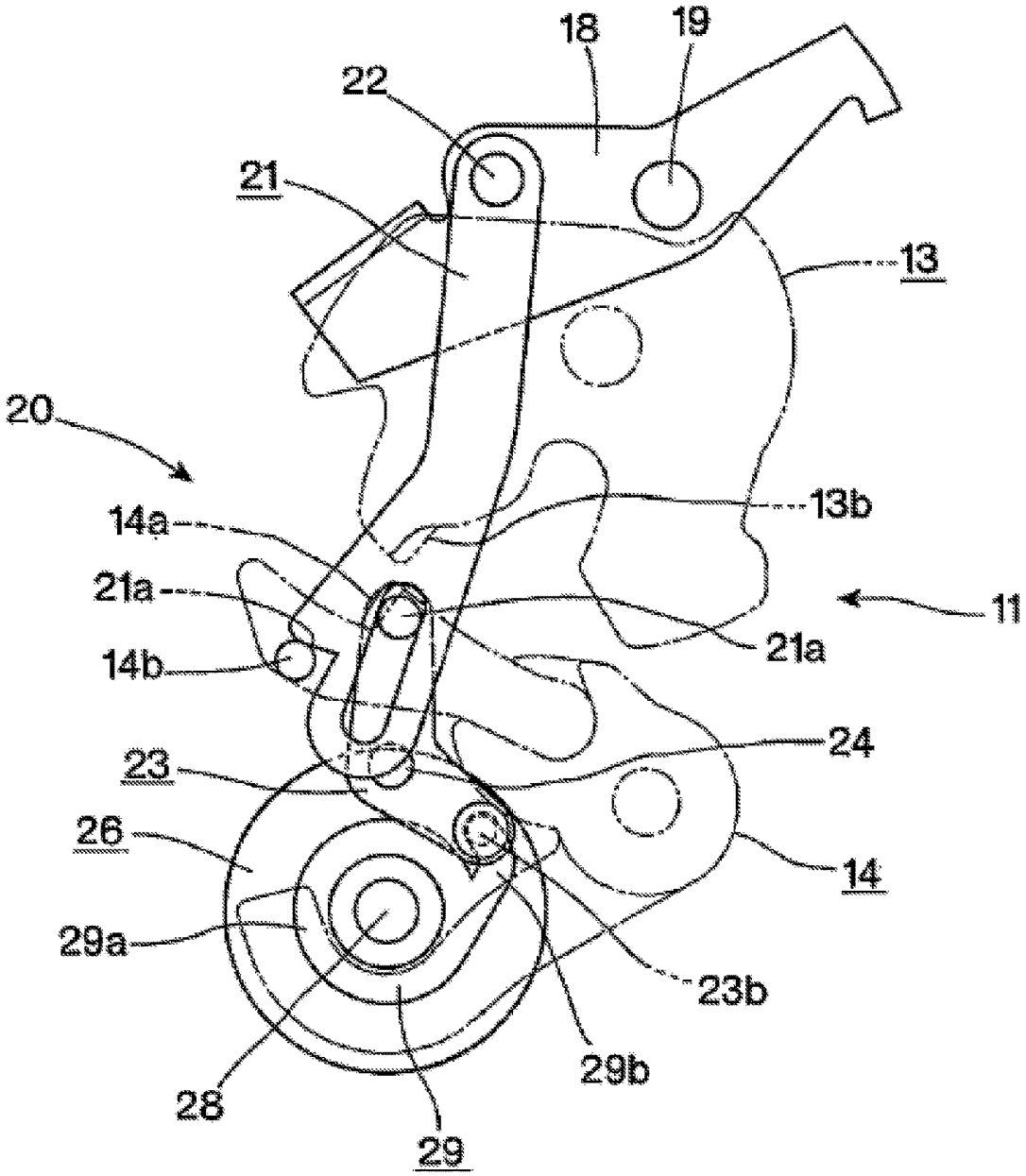
FIG. 4 is a front view showing the vehicle door latch apparatus when the door is opened by manual release means.
Figure 5:
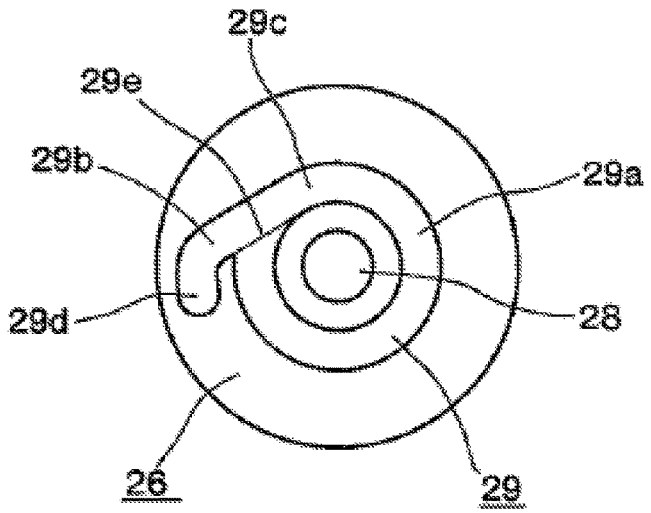
FIG. 5 is a front view of the cam wheel of the vehicle door latch apparatus.
Figure 6:
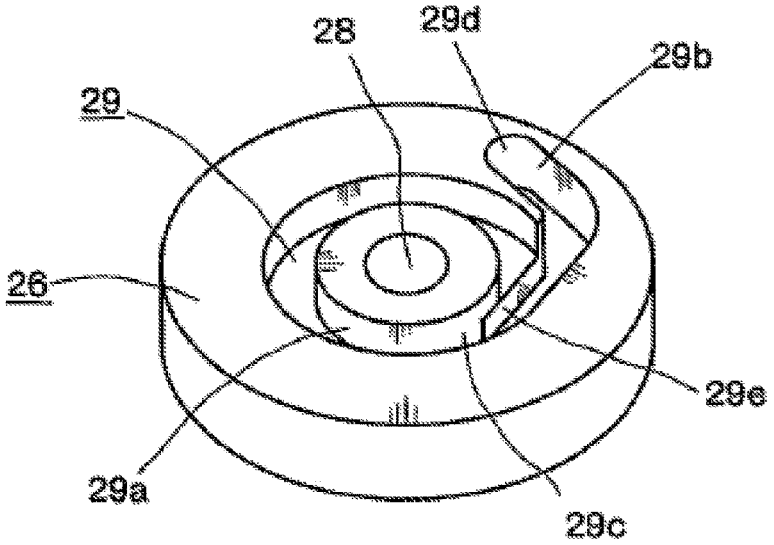
FIG. 6 is a perspective view of the cam wheel.

In the unlocked state shown in FIG. 3, when opening lever 18 is rotated counterclockwise by manual release means 17 in order to make opening link 21 move down, abutting surface 21*a* abuts against ratchet pin 14*b*. As a result, ratchet 14 is disengaged from latch 13 (latch mechanism 11 is released), and the door is ready to be opened, as shown in FIG. 4.

Vehicle door latch apparatus 10 has powered release means 25 that can release latch mechanism 11. Powered release means 25 has cam wheel 26 and motor 27 that rotates cam wheel 26. Cam wheel 26 is supported by cam shaft 28. As will be described later, powered release means 25 is connected both to lock mechanism 20 and to ratchet restraint 35. Powered release means 25 not only functions as a latch releasing mechanism that releases latch mechanism 11 by unblocking ratchet restraint 35, but also as a lock switching mechanism that maintains the locked state of lock mechanism 20 and that switches lock mechanism 20 to the unlocked state.

Cam wheel 26 is provided with cam groove 29 that follower pin 23*b* slidably engages. Cam groove 29 has annular groove 29*a* and branch groove 29*b*. Annular groove 29*a* is a circular groove whose center is at cam shaft 28 (i.e., coaxial with the rotational center of cam wheel 26). Branch groove 29*b* branches from annular groove 29*a* generally in the tangential direction and in the forward direction with respect to the rotation of the cam groove in the normal rotational direction, and extends away from cam shaft 28 or away from the rotational center of cam wheel 26. Inner end 29*c* of branch groove 29*b* communicates with annular groove 29*a*, and outer end 29*d* is positioned further away from cam shaft 28 than inner end 29*c*.

FIGS. 1 and 2 show cam wheel 26 that is at the reference position. When cam wheel 26 is at the reference position, follower pin 23*b* of follower lever 23 engages annular groove 29*a*, and lock mechanism 20 is in the locked state. Cam wheel 26 is rotated in the normal rotational direction (counterclockwise) and in the opposite direction (clockwise) from the reference position by the power of motor 27.

In the door closed state shown in FIG. 2, when powered release means 25 is activated by a door opening operation switch (not illustrated) or the like, cam wheel 26 is rotated in the normal rotational direction (counterclockwise) from the reference position. The rotation in the normal rotational direction is transmitted to latch mechanism 11, preferably to ratchet 14, then rotates ratchet 14 in the releasing direction (counterclockwise) in FIG. 2 to release latch mechanism 11 or to make latch mechanism 11 ready to be released. Detailed description will be made later with reference to FIGS. 14A-14D. The rotation of cam wheel 26 in the normal rotational direction preferably continues until it is rotated 360 degrees back to the reference position. Meantime, since follower pin 23*b* only makes relative movement within annular groove 29*a*, follower lever 23 is not moved, opening link 21 is held at the first position, and the locked state of lock mechanism 20 is continued.

In contrast, in the door closed state shown in FIG. 2, when motor 27 of powered release means 25 is rotated reversely to rotate cam wheel 26 reversely (clockwise) from the reference position, follower pin 23*b* of follower lever 23 relatively enters branch groove 29*b* from annular groove 29*a*, as shown in FIG. 3. Thus, follower lever 23 is rotated counterclockwise about support shaft 24, so as to switch follower lever 23 and opening link 21 to the unlocked position (opening link 21 is moved to the second position), and the door can be opened by manual release means 17. Motor 27 is turned off after making a reverse rotation of predetermined angles, and cam wheel 26 is held at the position shown in FIG. 3. In this way, follower lever 23 switches opening link 21 to the first or second position depending on the position of the follower pin.

In the unlocked state shown in FIG. 3, when cam wheel 26 is rotated in the normal rotational direction (clockwise) to the reference position by motor 27 of powered release means 25, follower pin 23*b* returns to annular groove 29*a*, and follower lever 23 and opening link 21 return to the locked position, as shown in FIG. 2. At this time, latch mechanism 11 is not released. Motor 27 is turned off after making a reverse rotation of predetermined angles, and cam wheel 26 is held at the reference position in FIG. 2.

Therefore, in the present embodiment, it is possible to switch lock mechanism 20 to the locked state and the unlocked state by rotating single motor 27 in the normal and reverse rotational directions, without releasing latch mechanism 11. The switching operation may be performed based on a user's intention or information from various sensors. The user may use a lock control switch or a remote controller (not illustrated) in order to switch lock mechanism 20 based on his/her intention. It is also possible to instantaneously switch lock mechanism 20 to a preferable state based on the information from an acceleration sensor or from a vehicle speed sensor.

In the present embodiment, in order to ensure that follower pin 23*b* is guided into branch groove 29*b* when cam wheel 26 is reversely rotated from the reference position, a step is provided on cam groove 29 in order to form guide wall 29*e*. Annular groove 29*a* gradually becomes shallow from the reference position, and guide wall 29*e*, which is formed by the step, is provided where annular groove 29*a* intersects branch groove 29*b*. In other words, guide wall 29*e* provides a step where branch groove 29*b* branches from annular groove 29*a*, wherein the step is shallow on the forward side with respect to the normal rotational direction of cam groove 29 and is deep on the opposite side. In this case, follower pin 23*b* may be a floating pin that is movable in the axial direction in order to eliminate the influence of the step. It is also possible to ensure that follower pin 23*b* is guided into branch groove 29*b* by biasing follower lever 23 in the counterclockwise direction with a weak elastic force.

Annular groove 29*a* is circular in the present embodiment, but annular groove 29*a* may also be an arc-shaped groove. In such a case, in order to release latch mechanism 11 by means of powered release means 25, cam wheel 26 is rotated in the normal rotational direction predetermined angles from the reference position, and is then rotated reversely back to the reference position.

Figure 7:
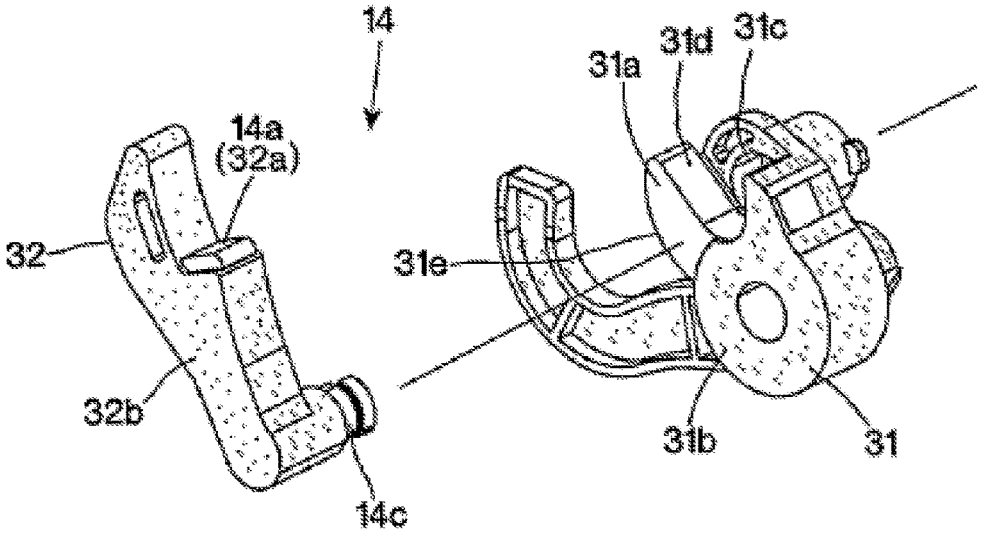
FIG. 7 is an exploded perspective view of the ratchet.
Figure 8:
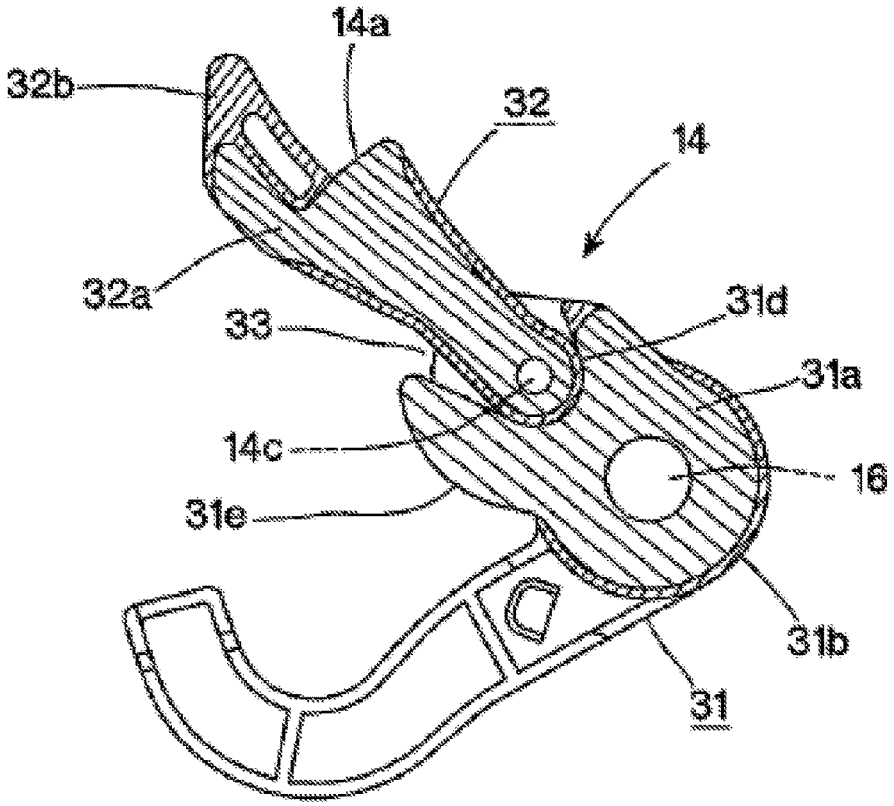
FIG. 8 is a longitudinal cross-sectional view of the ratchet.
Figure 9:
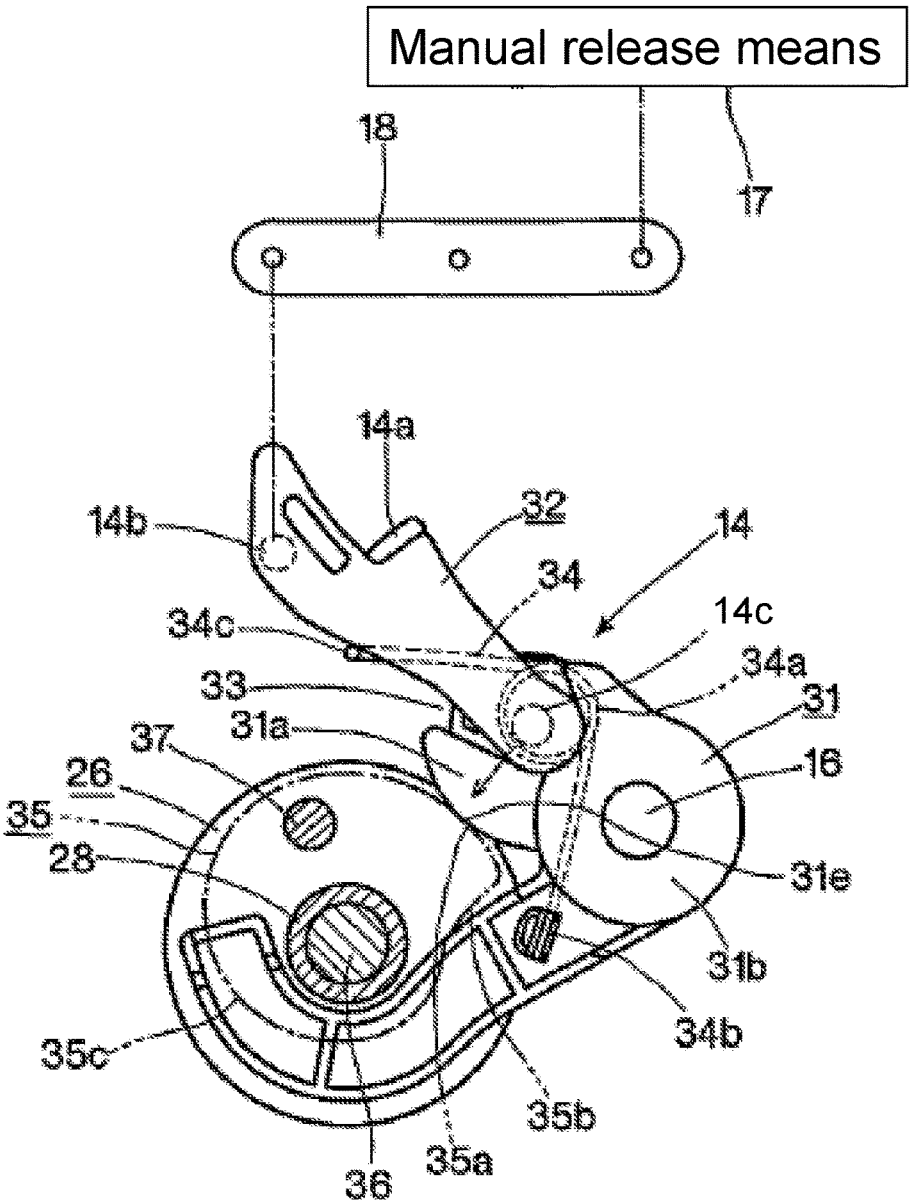
FIG. 9 is a partial longitudinal front view showing the ratchet, the manual release means and the cam wheel.
Figure 10:
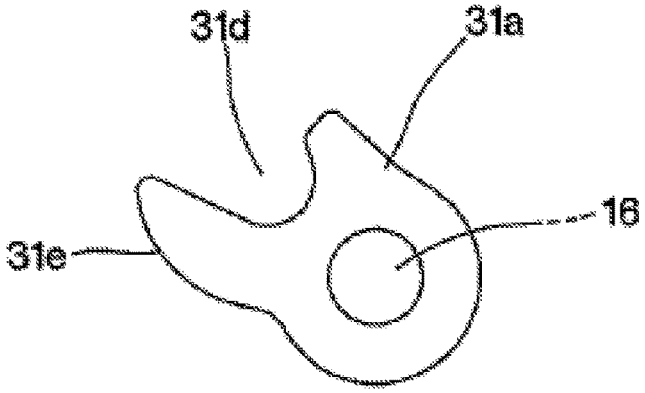
FIG. 10 is a front view of the metal plate of the base lever of the ratchet.
Figure 11:
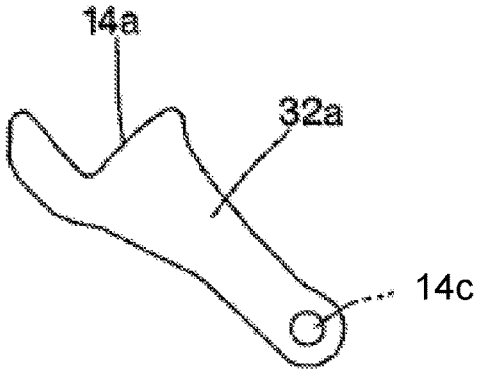
FIG. 11 is a front view of the metal plate of the pawl lever of the ratchet.
Figure 12:
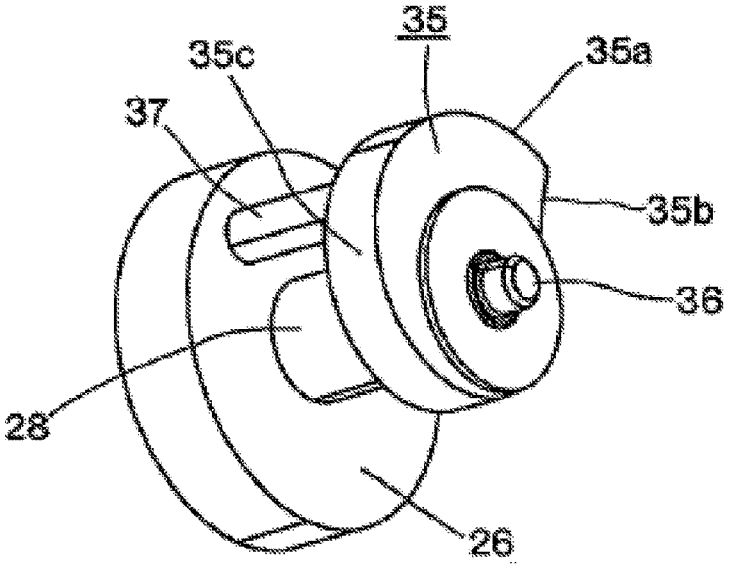
FIG. 12 is a perspective view of the ratchet restraint and the cam wheel.

In FIG. 7 and following figures, the configuration to release latch mechanism 11 by power release mechanism 25, i.e., the configuration to release ratchet 14 from latch 13 by the rotation of cam wheel 26 (motor 27) in the normal rotational direction is shown.

Ratchet 14 of the present embodiment is divided into base lever 31 and pawl lever 32. Base lever 31 and pawl lever 32 are insert molded and have metal plates 31*a*, 32*a*, which are the main structures, and resin covers 31*b*, 32*b*, respectively.

The base portion of base lever 31 is rotatably supported by ratchet shaft 16, and the base portion of pawl lever 32 is rotatably supported by connecting shaft 14*c* at the end of base lever 31. Connecting shaft 14*c*, which is formed integral with pawl lever 32, is rotatably supported by shaft hole 31*c* that is formed in resin cover 31*b*. Pawl portion 14*a* is formed at the end of metal plate 32*a* of pawl lever 32.

Bifurcating portion 31*d* is formed at an end of metal plate 31*a* of base lever 31, and the base portion of pawl lever 32 is housed in bifurcating portion 31*d*. Gap 33 is formed between the base portion of pawl lever 32 and bifurcating portion 31*d*. Gap 33 allows pawl lever 32 to rotate about connecting shaft 14*c* over predetermined angles independent of base lever 31.

Ratchet 14 is biased by ratchet spring 34 in a direction in which pawl lever 32 engages latch 13. Ratchet spring 34 is preferably a torsion coil spring. Central coil portion 34*a* is disposed about the outer circumference of connecting shaft 14*c* with one spring leg portion 34*b* in contact with base lever 31 and the other spring leg portion 34*c* in contact with pawl lever 32.

When the door is closed, due to elastic force of latch spring (not illustrated) and the resilient force of the sealing member (not illustrated) that is provided between the door and the vehicle body, latch 13 is subjected to force that returns latch 13 in door in the releasing direction (counterclockwise) (hereinafter, "latch returning force"). The latch returning force is transmitted from full latch engaging portion 13*b* of latch 13 to ratchet 14 via pawl portion 14*a*.

In the door closed state, that is, in a state in which ratchet 14 engages latch 13, when ratchet 14 is subjected to the latch returning force from latch 13, the force that pushes ratchet 14 in the latch releasing direction (hereinafter, "release component force") acts on connecting shaft 14*c* of ratchet 14. In other words, ratchet 14 is subjected to the latch returning force to release latch 13. This force moves connecting shaft 14*c*, and ratchet 14 is deformed such that ratchet 14 is bent at the central portion by ratchet spring 34. Thus, since ratchet 14 is pushed from latch 13 by the latch returning force and is disengaged from latch 13, ratchet 14 itself cannot maintain latch 13 at the fully-latched position against the latch returning force (the release component force).

Figure 13:
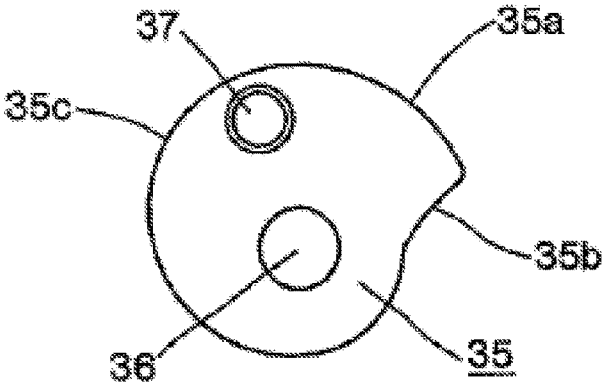
FIG. 13 is a front view of the ratchet restraint.
Figure 14A:
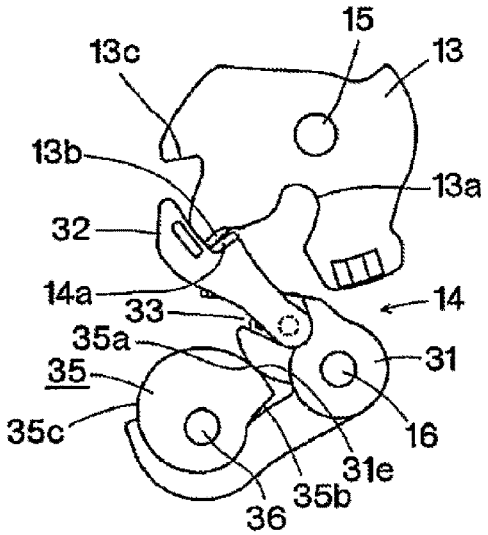
FIG. 14A is a view showing the door opening operation (in the full-latched state)
Figure 14B:
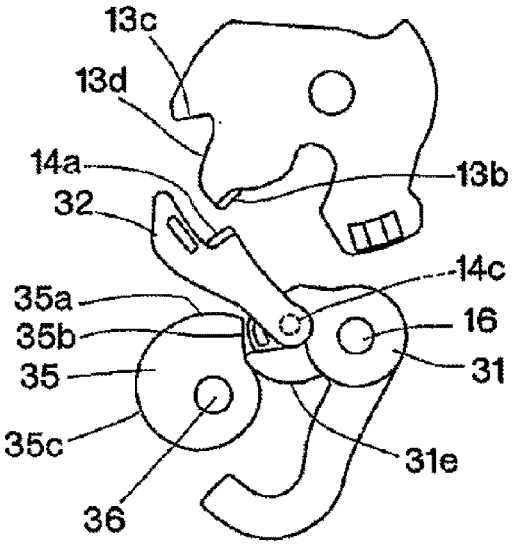
FIG. 14B is a view showing the door opening operation (when the ratchet restraint is moved to the release position to unblock the base lever)
Figure 14C:
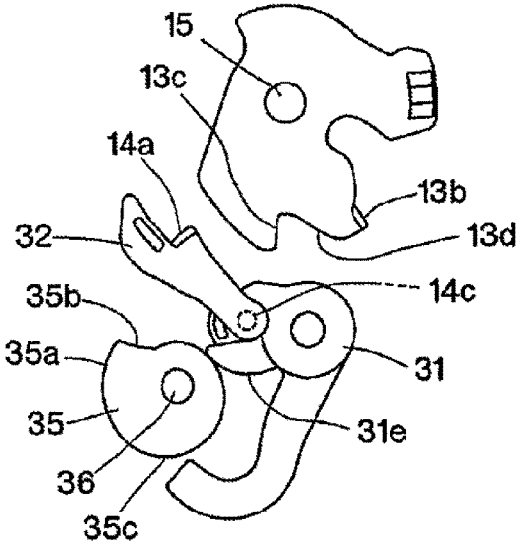
FIG. 14C is a view showing the door opening operation (when the latch is returned to the unlatched position)

Ratchet restraint 35 that can prevent ratchet 14 from moving in the latch releasing direction is arranged near the side of ratchet 14. Ratchet restraint 35 presses (blocks) ratchet 14 in a direction that keeps latch 13 engaged with ratchet 14. Ratchet restraint 35 is rotatably supported by support shaft 36. Ratchet restraint 35 is rotated 360 degrees about support shaft 36 so that ratchet restraint 35 is moved to the blocked position (FIG. 14A, FIG. 14D), to the release position (FIG. 14B) and to the abutting position (FIG. 14C). As shown in FIG. 13, ratchet restraint 35 has, on the outer circumference thereof, blocking surface 35*a*, releasing surface 35*b* and return cam surface 35*c*.

Blocking surface 35*a* of ratchet restraint 35 has an arcuate shape whose center is at support shaft 36. When ratchet restraint 35 is at the blocked position, blocking surface 35*a* faces one outer walls 31*e* of base lever 31.

In the blocking state where blocking surface 35*a* faces outer wall 31*e*, even if the latch return force is transmitted from latch 13 to ratchet 14 and the release component force acts on connecting shaft 14*b* in the latch releasing direction, the release component force will be securely supported by arc-shaped blocking surface 35*a*, and connecting shaft 14*b* (base lever 31) cannot be moved in the latch releasing direction. Therefore, in the blocking state, ratchet 14 stays engaged with latch 13, and the door remains closed, as shown in FIG. 14A.

The blocked position of ratchet restraint 35 is also the initial or waiting position, and ratchet restraint 35 is usually kept at the blocked position.

Releasing surface 35*b* is formed to have a shorter diameter than blocking surface 35*a*. When ratchet restraint 35 is rotated counterclockwise in FIG. 14A, releasing surface 35*b* faces outer wall 35*e* and releases base lever 31 that is blocked. Then, base lever 31 is moved in the latch releasing direction from the restricted position to the non-restricted position by the release component force, as shown in FIG. 14B. When base lever 19 is moved to the non-restricted position, pawl portion 14*a* is ejected from full-latch engaging portion 13*b* in the latch releasing direction, and as a result, latch 13 is disengaged from ratchet 14 and the door can be opened.

The position where releasing surface 35*b* faces outer wall 31*e* corresponds to the position where ratchet restraint 35 is released. Further, the restricted position of base lever 31 corresponds to the position where outer wall 31*e* abuts against blocking surface 35*a* that is at the blocked position, and the non-restricted position of base lever 31 corresponds to the position where base lever 31 is moved in the latch releasing direction by the release component force, so as to allow latch 13 to be disengaged from ratchet 14.

Return cam surface 35*c* is provided between releasing surface 35*b* and blocking surface 35*a* such that the diameter increases from releasing surface 35*b* to blocking surface 35*a*. When base lever 31 is moved to the non-restricted position where base lever 31 faces releasing surface 35*b*, base lever 31 is gradually pushed in the latch engaging direction by outer wall 31*e* abutting against return cam surface 35*c*, and returns to the restricted position. The position where releasing surface 35*b* faces outer wall 31*e* corresponds to the abutting position of ratchet restraint 35.

Half latch engaging portion 13*c* is provided on the outer circumference of latch 13. When latch 13 is in the half-latched state where pawl portion 14*a* of ratchet 14 engages half latch engaging portion 13*c*, latch 13 can be rotated toward the fully-latched position by pushing the door in the door closing direction. Thus, tilted connecting surface 13*d* that is formed between half-latch engaging portion 13*c* and full-latch engaging portion 13*d* abuts against pawl lever 32, so that pawl lever 32 is rotated in the latch releasing direction about connecting shaft 14*c*. At this time, pawl lever 32 is moved in the latch releasing direction alone without rotating base lever 19 due to gap 33, and latch mechanism 11 is switched from the half-latched state to full-latched state.

Ratchet restraint 35 is moved by electric release operation force from powered release means 25. Cam wheel 26 is preferably coupled to motor 27 of powered release means 25 via a worm reduction mechanism (not illustrated). The center of cam shaft 28 of cam wheel 26 corresponds to the center of support shaft 36 of ratchet restraint 35. Cam shaft 28 may be shared with support shaft 36, but in the present embodiment, cam shaft 28 is a hollow shaft, and support shaft 36 is inserted into the hollow portion.

Cam wheel 26 and ratchet restraint 35 are connected to each other by connecting pin 37 so that they rotate together. Thus, when powered release means 25 is activated, the power of motor 27 causes cam wheel 26 to rotate, which in turn rotates ratchet restraint 35 counterclockwise via connecting pin 37 in FIG. 9 and FIGS. 14A-14D.

FIGS. 14A-14D sequentially show the operation of ratchet 14 and latch 13 that occurs due to the rotation of ratchet restraint 35. Ratchet restraint 35 takes about 850 milliseconds to rotate 360 degrees, while latch 13 returns from the full-latched position to the unlatched position in a short time of about 50 milliseconds due to the latch return force. For this reason, the movement of each part over time is shown in an exaggerated manner in FIGS. 14A to 14D.

When cam wheel 26 is rotated in the normal rotational direction from the reference position by the activation of powered release means 25, ratchet restraint 35 is rotated counterclockwise in the full-latched state shown in FIG. 14A. As a result, outer wall 31*e* of base lever 31 is disengaged from blocking surface 35*a* and then faces releasing surface 35*b*, and base lever 31 is released from the blocking of ratchet restraint 35, as shown in FIG. 14B. When the blocking is released, base lever 31 is rotated counterclockwise by the release component force acting on connecting shaft 14*b*. Meanwhile, pawl lever 32 is biased clockwise by the elastic force of ratchet spring 34. Therefore, ratchet 14 is bent at the central portion (that is, pawl lever 32 is rotated relative to base lever 31), and pawl portion 14*a* is ejected from full-latch engaging portion 13*b* in the latch releasing direction. Then, latch 13 is rotated in the releasing direction, and the door is opened (see FIG. 14C).

The counterclockwise rotation of ratchet restraint 35 by powered release means 25 continues after latch 13 is released, and then return cam surface 35*c* of ratchet restraint 35 abuts outer wall 31*e* of base lever 31. Then, return cam surface 35*c* gradually pushes base lever 31 in the latch engaging direction (see FIG. 14C) to return base lever 31 to the restricted position. Base lever 31 is then held at the restricted position by blocking surface 35*a* of ratchet restraint 35, as shown in FIG. 14D.

Figure 14D:
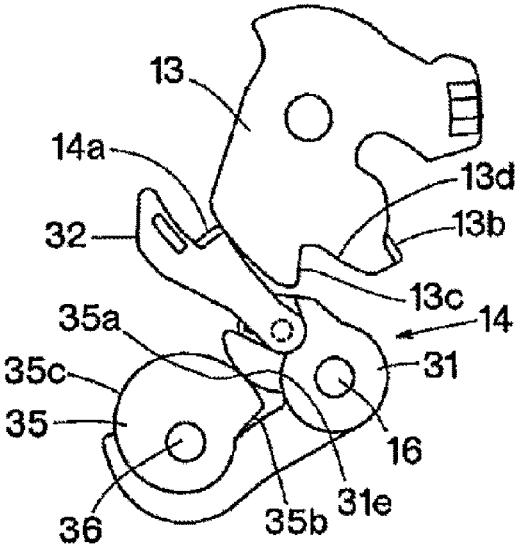
FIG. 14D is a view showing the door opening operation (when the ratchet restraint has rotated 360 degrees to return to the blocked position)
Figure 15:
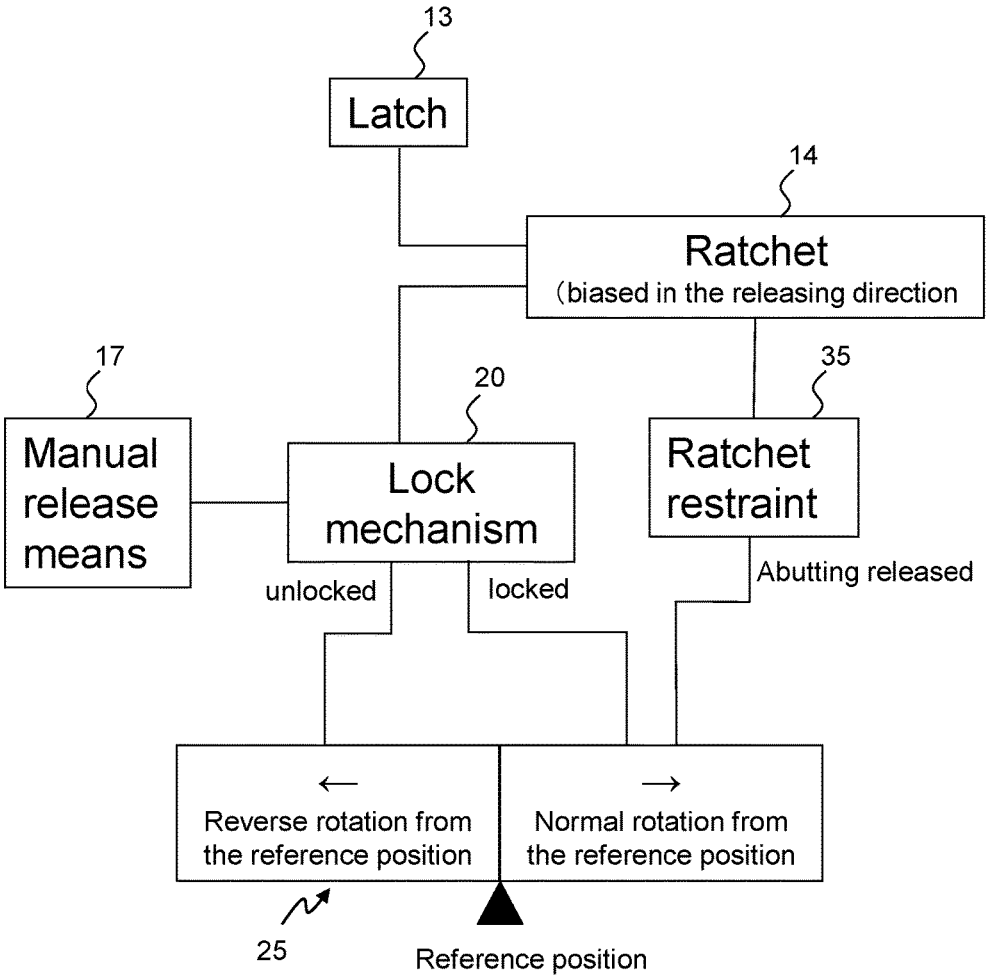
FIG. 15 is a schematic view generally showing the configuration of the vehicle door latch apparatus of the present invention.

Powered release means 25 halts when ratchet restraint 35 (cam wheel 26) is rotated 360 degrees to return to the initial position (the reference position), as shown in FIG. 14D. At this time, since follower pin 23*b* of follower lever 23 only relatively moves within annular groove 29*a* of cam wheel 26, follower lever 23 is not moved and the locked state of lock mechanism 20 is continued.

In order to release latch mechanism 11 by powered release means 25 when annular groove 29*a* is an arc-shaped groove, not a circular groove, cam wheel 26 makes rotation of predetermined angles in the normal rotational direction from the reference position, and then cam wheel 26 is rotated reversely back to the reference position. In this case, ratchet restraint 35 releases base lever 31 at releasing surface 35*b*, and then returns base lever 31 to the restricted position at the same releasing surface 35*b*. For this reason, releasing surface 35*b* is shaped such that it has the function of return cam surface 35*c*.

Thus, output required for powered release means 25 can be extremely reduced because ratchet 14 is disengaged from latch 13 by the latch returning force (the release component force). In addition, since ratchet 14 is divided into base lever 31 and pawl lever 32, it is possible to reasonably combine the releasing operation of latch mechanism 11 by powered release means 25 and the releasing operation of latch mechanism 11 by manual release means 17 without affecting each other.

It is also possible to release latch mechanism 11 by directly transmitting the rotation of cam wheel 26 to ratchet 14 through path 30 and thereby rotate the ratchet.

While several preferred present embodiments of the present invention have been shown and described in detail, it should be understood that various changes and modifications can be made without departing from the spirit or scope of the appended claims.

What is claimed is:

1. A vehicle door latch apparatus comprising:

a latch that engages a striker of a vehicle;

a ratchet that can engage the latch;

powered release means that can release the latch with motor power;

manual release means that can release the latch with manual operation force; and a lock mechanism that is switched between a locked state where the manual release means is deactivated and an unlocked state where the manual release means can be activated; and a ratchet restraint that blocks the ratchet in a direction in which the ratchet stays engaged with the latch, wherein the powered release means has a cam wheel that is rotated in normal and in reverse rotational directions from a reference position by motor power, when the cam wheel is at the reference position, the lock mechanism is held in the locked state, when the cam wheel is rotated in the normal rotational direction from the reference position, the cam wheel can release the latch while the lock mechanism is held in the locked state, when the cam wheel is rotated in the reverse rotational direction from the reference position, the cam wheel switches the lock mechanism to the unlocked state, the cam wheel returns the lock mechanism to the locked state when the cam wheel is rotated in the normal rotational direction back to the reference position after the cam wheel is rotated in the reverse rotational direction from the reference position, and the cam wheel is rotated 360 degrees in the normal rotational direction from the reference position back to the reference position in order to rotate the ratchet restraint 360 degrees.

2. The vehicle door latch apparatus according to claim 1, wherein the lock mechanism has a follower lever that is not moved when the cam wheel is rotated in the normal rotational direction from the reference position and that is moved when the cam wheel is rotated in the reverse rotational direction from the reference position.

3. The vehicle door latch apparatus according to claim 2, wherein the cam wheel has an annular groove and a branch groove that communicates with the annular groove.

4. A vehicle door latch apparatus comprising:

a latch that can engage a striker of a vehicle and that is biased in a door opening direction;

a ratchet that can engage the latch and that is subjected to return force when the ratchet engages the latch, wherein the return force acts in a direction in which the ratchet is disengaged from the latch;

a ratchet restraint that is separate from the ratchet and that blocks the ratchet in a direction in which the ratchet stays engaged with the latch;

manual release means that can disengage the ratchet from the latch by manual operation force;

a lock mechanism that is coupled to the manual release means and the ratchet and that can be switched between a locked state where the manual release means is deactivated and an unlocked state where the manual release means can be activated; and a lock switching mechanism that is coupled to the lock mechanism and the ratchet restraint, wherein the ratchet is rotatably supported by a ratchet shaft, and the ratchet restraint is rotatably supported by a support shaft that is separate from the ratchet shaft, wherein the lock switching mechanism can be rotated in normal and in reverse rotational directions, wherein when the lock switching mechanism is rotated in the normal rotational direction, blocking by the ratchet restraint is released and the locked state of the lock mechanism is maintained, and when the lock switching mechanism is rotated in the reverse rotational direction, the lock switching mechanism is switched to the unlocked state.

5. The vehicle door latch apparatus according to claim 4, wherein the lock mechanism has an opening link and a follower lever that is connected to the opening link, wherein the opening link is movable between a first position, where the ratchet cannot be disengaged from the latch by operating the manual release means, and a second position, where the ratchet can be disengaged from the latch by operating the manual release means, wherein the lock switching mechanism has a cam wheel having a cam groove, wherein the cam wheel can be rotated in the normal and reverse rotational directions by motor power, and the follower lever has a follower pin that engages the cam groove and switches the opening link to the first position or the second position depending on a position of the follower pin.

6. The vehicle door latch apparatus according to claim 5, wherein the cam groove has an annular groove that is coaxial with a rotational center of the cam wheel and a branch groove that branches from the annular groove and that extends in a direction away from the rotational center, wherein the follower lever holds the opening link at the first position when the follower pin is positioned in the annular groove, and the follower lever moves the opening link to the second position when the follower pin is positioned in the branch groove.

7. A vehicle door latch apparatus comprising:

a latch that can engage a striker of a vehicle and that is biased in a door opening direction;

a ratchet that can engage the latch and that is subjected to return force when the ratchet engages the latch, wherein the return force acts in a direction in which the ratchet is disengaged from the latch;

a ratchet restraint that blocks the ratchet in a direction in which the ratchet stays engaged with the latch;

manual release means that can disengage the ratchet from the latch by manual operation force;

a lock mechanism that is coupled to the manual release means and the ratchet and that can be switched between a locked state where the manual release means is deactivated and an unlocked state where the manual release means can be activated; and a lock switching mechanism that is coupled to the lock mechanism and the ratchet restraint, wherein the lock switching mechanism can be rotated in normal and in reverse rotational directions, wherein when the lock switching mechanism is rotated in the normal rotational direction, blocking by the ratchet restraint is released and the locked state of the lock mechanism is maintained, and when the lock switching mechanism is rotated in the reverse rotational direction, the lock switching mechanism is switched to the unlocked state, wherein the lock mechanism has an opening link and a follower lever that is connected to the opening link, wherein the opening link is movable between a first position, where the ratchet cannot be disengaged from the latch by operating the manual release means, and a second position, where the ratchet can be disengaged from the latch by operating the manual release means, wherein the lock switching mechanism has a cam wheel having a cam groove, wherein the cam wheel can be rotated in the normal and reverse rotational directions by motor power, and the follower lever has a follower pin that engages the cam groove and switches the opening link to the first position or the second position depending on a position of the follower pin, wherein the cam groove has an annular groove that is coaxial with a rotational center of the cam wheel and a branch groove that branches from the annular groove and that extends in a direction away from the rotational center, wherein the follower lever holds the opening link at the first position when the follower pin is positioned in the annular groove, and the follower lever moves the opening link to the second position when the follower pin is positioned in the branch groove, wherein the branch groove branches in a tangential direction of the annular groove and in a forward direction with respect to the normal rotational direction of the cam groove.

8. The vehicle door latch apparatus according to claim 7, wherein the annular groove has a guide wall where the branch groove branches from the annular groove, wherein the guide wall is shallow on a side in the forward direction and that is deep on an opposite side.

* * * * *